US007470872B2

(12) United States Patent
Griffin

(10) Patent No.: US 7,470,872 B2
(45) Date of Patent: Dec. 30, 2008

(54) COOLING DEVICE AND SYSTEM FOR A PLASMA ARC TORCH AND ASSOCIATED METHOD

(75) Inventor: David C. Griffin, Florence, SC (US)

(73) Assignee: The Esab Group, Inc., Florence, SC (US)

( * ) Notice: Subject to any disclaimer, the term of this patent is extended or adjusted under 35 U.S.C. 154(b) by 128 days.

(21) Appl. No.: 11/363,796

(22) Filed: Feb. 28, 2006

(65) Prior Publication Data

US 2007/0210039 A1 Sep. 13, 2007

(51) Int. Cl.
*H05B 11/24* (2006.01)
*H05B 9/00* (2006.01)

(52) U.S. Cl. ..... 219/121.54; 219/121.39; 361/688

(58) Field of Classification Search ..... 219/121.54, 219/121.11, 121.39, 121.44, 121.56, 121.55, 219/121.49, 137.63, 136, 116, 108, 110; 439/194; 700/166, 174, 175, 165, 117; 361/688
See application file for complete search history.

(56) References Cited

U.S. PATENT DOCUMENTS 5,290,995 A 3/1994 Higgins et al.
5,378,870 A * 1/1995 Krupnicki ..... 219/137.63
5,880,426 A 3/1999 Fukui et al.
5,998,240 A 12/1999 Hamilton et al.
6,081,423 A * 6/2000 Griffin ..... 361/688
6,400,012 B1 6/2002 Miller et al.
6,567,262 B2 5/2003 Meir
6,588,647 B2 7/2003 Yamada et al.
6,729,383 B1 5/2004 Cannell et al.
6,772,040 B1 8/2004 Picard et al.
2002/0117291 A1 8/2002 Cheon

* cited by examiner

*Primary Examiner*—Quang T Van
(74) *Attorney, Agent, or Firm*—Alston & Bird LLP

(57) ABSTRACT

A plasma arc generation system includes a power module operably engaged with a plasma arc torch head portion and adapted to provide an electrical current for causing an arc at the torch head portion or generating a plasma. A cooling device is operably engaged with the power module so as to direct a fluid thereto for cooling the power module. The cooling device is configured such that the fluid directly contacts the power module to receive heat therefrom generated by the power module. Associated systems and methods are also provided.

14 Claims, 6 Drawing Sheets

COOLING DEVICE AND SYSTEM FOR A PLASMA ARC TORCH AND ASSOCIATED METHOD

BACKGROUND OF THE INVENTION

1. Field of the Invention

The present invention relates to a plasma arc torch and, more particularly, to a cooling device and system for a plasma arc torch and associated method.

2. Description of Related Art

Figure 1:
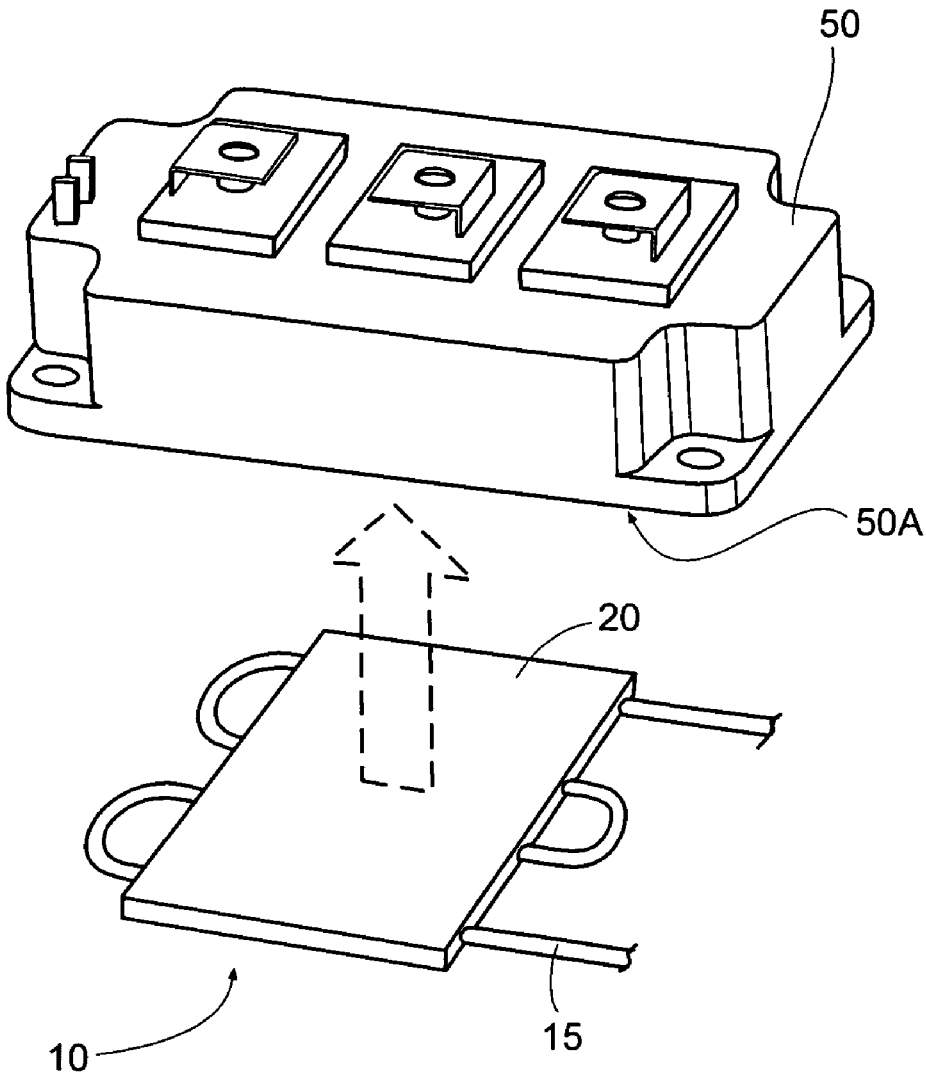
FIG. 1 (Prior Art)

Certain welding and cutting equipment, including plasma arc torches and associated equipment, often require significant electrical power supplies for effective operation. Such power supplies may include one or more power modules that generate the power required for torch operation. For example, the power modules may be required to collectively provide from about 1-120 kilowatts (kW) or more of power for a torch. These power modules may be, for instance, IGBTs, SCRs or other suitable power modules. One example of a typical power module 50 is shown in FIG. 1. In generating the power for the torch, such power modules also generate a significant amount of heat. As such, one surface of the power module, such as the bottom surface, may be configured to be flat and smooth so as to allow the surface to engage a heat sink device for removing excess heat from the power module. In some instances, the heat sink device is a metal component provided with multiple fins to increase surface area of the heat sink device and thereby enhance convection of the heat away from the heat sink device. In further cases, the heat sink device may be subjected to a stream of air blown across the fins to further enhance convection of the heat. In this manner, the goal is to limit the temperature of the power module during torch operation to an acceptable level.

In some instances, the heat sink device may comprise a discrete and closed liquid cooling plate as shown, for example, in FIG. 1. The cooling plate 10 includes a fluid circuit 15 for a liquid coolant encased within, for example, a metallic heat-conducting element 20 generally forming the overall structure of the cooling plate 10. The self-contained cooling plate 10 is engaged with a surface, such as the bottom surface, of the power module 50 to provide cooling therefor. Such a cooling plate 10 may also implement its own circulating cooling system (separate from the cooling system used to cool the torch head) including, for instance, a pump and a heat exchanger, for circulating a cooling fluid through the fluid circuit 15 to provide a medium for removing heat from the power module 50. However, in such a configuration, the heat from the power module 50 must pass through the material of the heat conducting element 20, as well as the material of the fluid circuit 15, before reaching the liquid coolant. In some instances, an interface material such as a gasket or thermal grease may be disposed between the heat-conducting element 20 and the power module 50 (as well as between the heat sink device and the power module in the above-described air-cooled heat sink), which may further increase the components through which the conducted heat must pass in order to reach the cooling fluid. As such, these thermal conduction issues may limit the cooling efficiency of the cooling plate 10 in this application.

In any instance, the separate configurations (air-cooled heat sink or separate cooling plate) for cooling the power module(s) may tend to be inefficient or insufficient mechanisms for removing heat from the power module. Inefficient or insufficient removal of heat from the power module may cause a reduction in the power output thereof. In such cases, a larger power module, or additional power modules, may be required to provide sufficient power for operating the torch. In addition, the separate provisions (air-cooled heat sink or separate cooling plate) for cooling the power module(s) may, in some instances, result a bulkier or larger power supply for the torch (due to the extra components), a costlier power supply (and costlier system overall), possibly a less reliable power supply, or a more complex power supply.

Thus, there exists a need for a simpler and more efficient cooling system for the power module(s) of a power supply, wherein such a cooling system may also desirably provide increased reliability, less cost, and a smaller or less bulky power supply for the torch.

BRIEF SUMMARY OF THE INVENTION

The above and other needs are met by the present invention which, in one embodiment, provides a plasma arc generation system, comprising a power module operably engaged with a plasma arc torch head portion and adapted to provide an electrical current for causing an arc at the torch head portion for generating a plasma. A cooling device is operably engaged with the power module so as to direct a fluid thereto for cooling the power module. The cooling device is configured such that the fluid directly contacts the power module to receive heat therefrom generated by the power module.

Another aspect of the present invention provides a plasma arc generation system, comprising a plasma arc torch head portion adapted to receive an electrical current and configured such that the electrical current causes an arc at the torch head portion for generating a plasma. A power module is operably engaged with the torch head portion and is adapted to provide the electrical current thereto. A cooling device is operably engaged with the power module so as to direct a fluid thereto for cooling the power module. The cooling device is configured such that the fluid directly contacts the power module to receive heat therefrom generated by the power module.

A further aspect of the present invention provides a method of cooling a plasma arc generation system. First, a fluid is directed to a power module, wherein the power module is operably engaged with a plasma arc torch head portion and is adapted to provide an electrical current thereto for causing an arc at the torch head portion for generating a plasma, such that the fluid directly contacts the power module to receive heat therefrom generated by the power module. The fluid is also directed to the torch head portion so as to receive heat therefrom generated by the plasma. The fluid is further directed one of serially between and in parallel to the power module and the torch head portion so as to provide cooling for the plasma arc generation system.

Thus, embodiments of the present invention provide significant advantages as further detailed herein. More particularly, such embodiments provide a simpler and more efficient cooling system for the power module(s) of a torch power supply, with increased reliability and less cost, and results in a smaller or less bulky power supply.

BRIEF DESCRIPTION OF THE SEVERAL VIEWS OF THE DRAWING(S)

Figure 2:
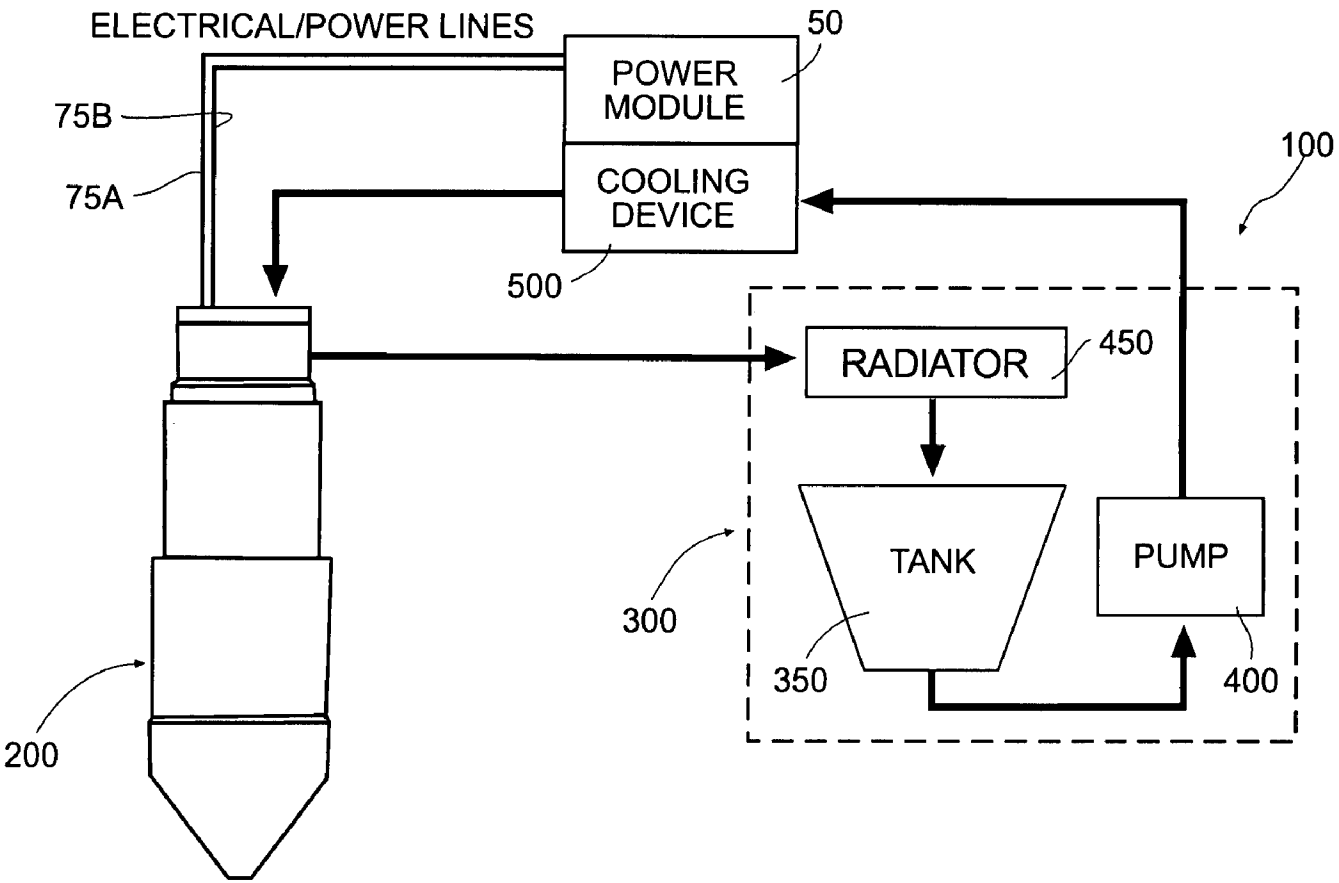
Figure 3:
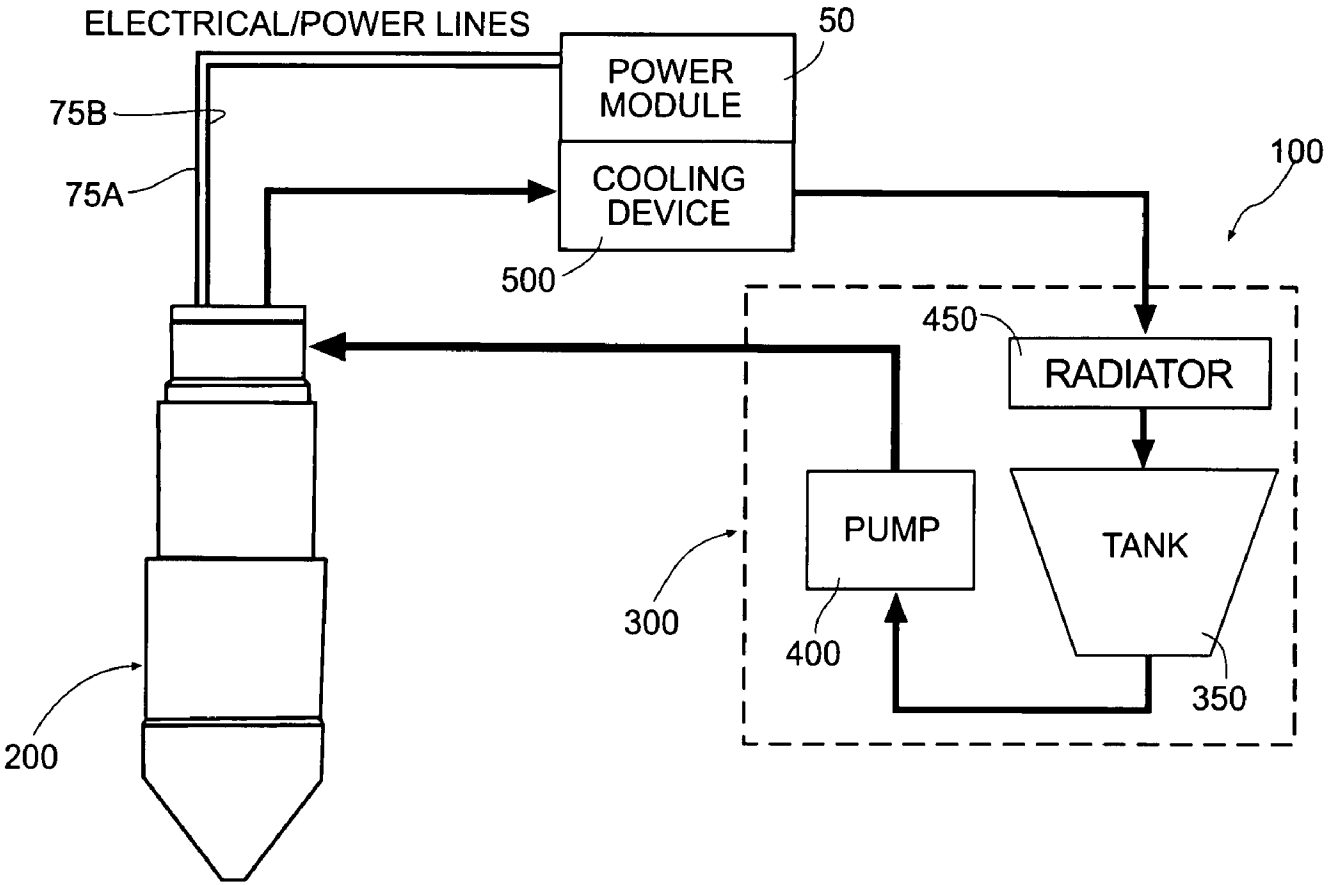
Figure 4:
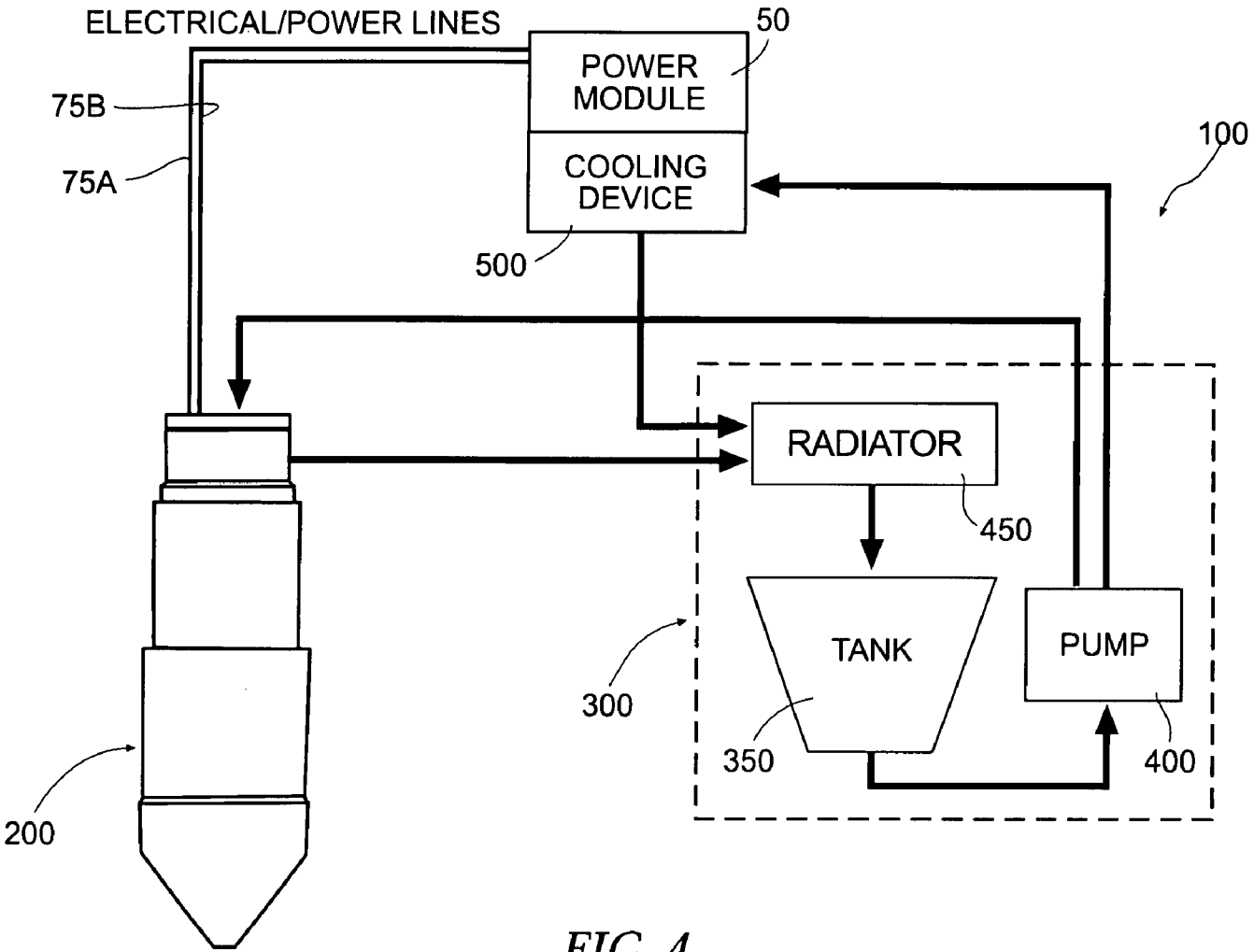
Figure 5:
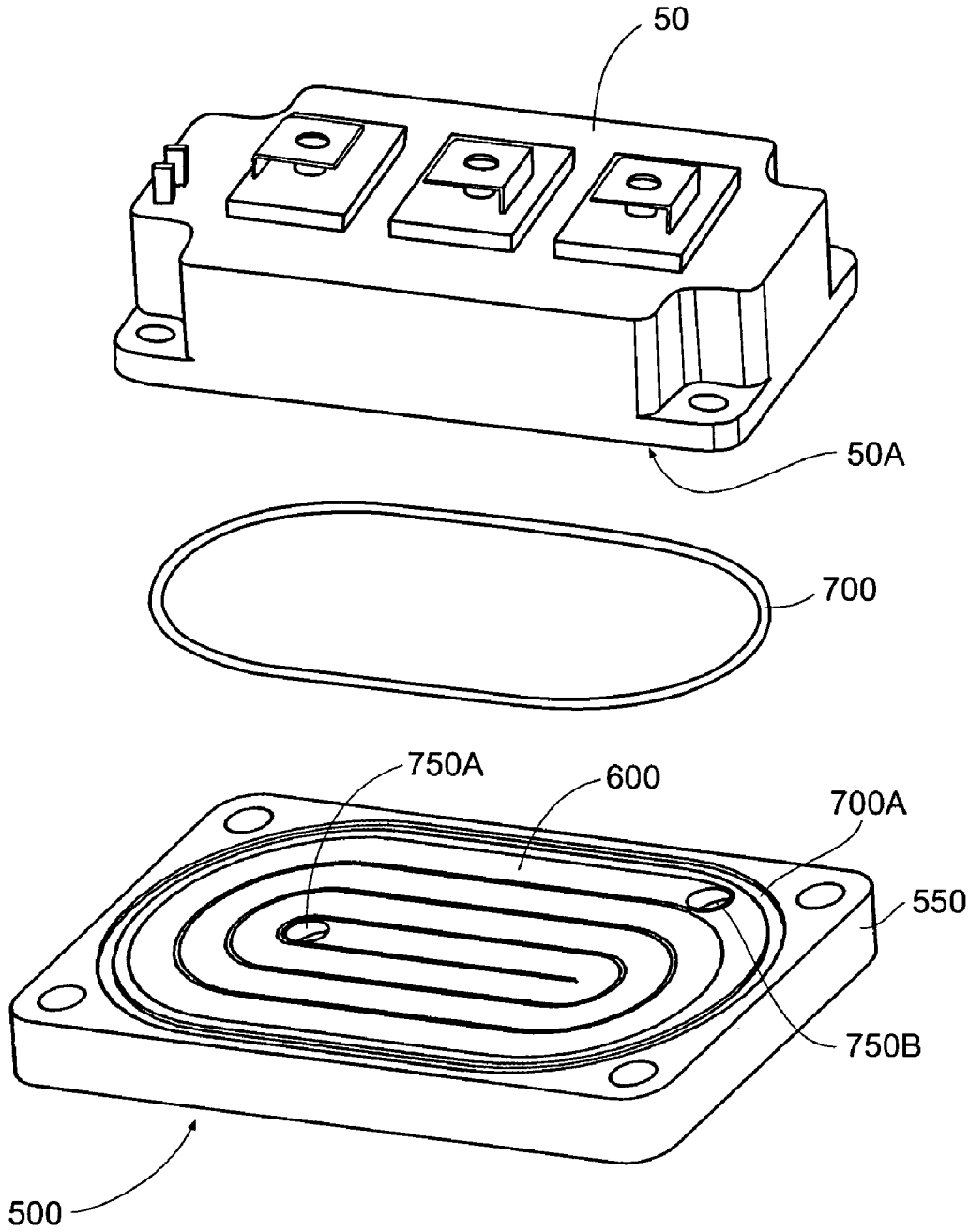
Figure 6:
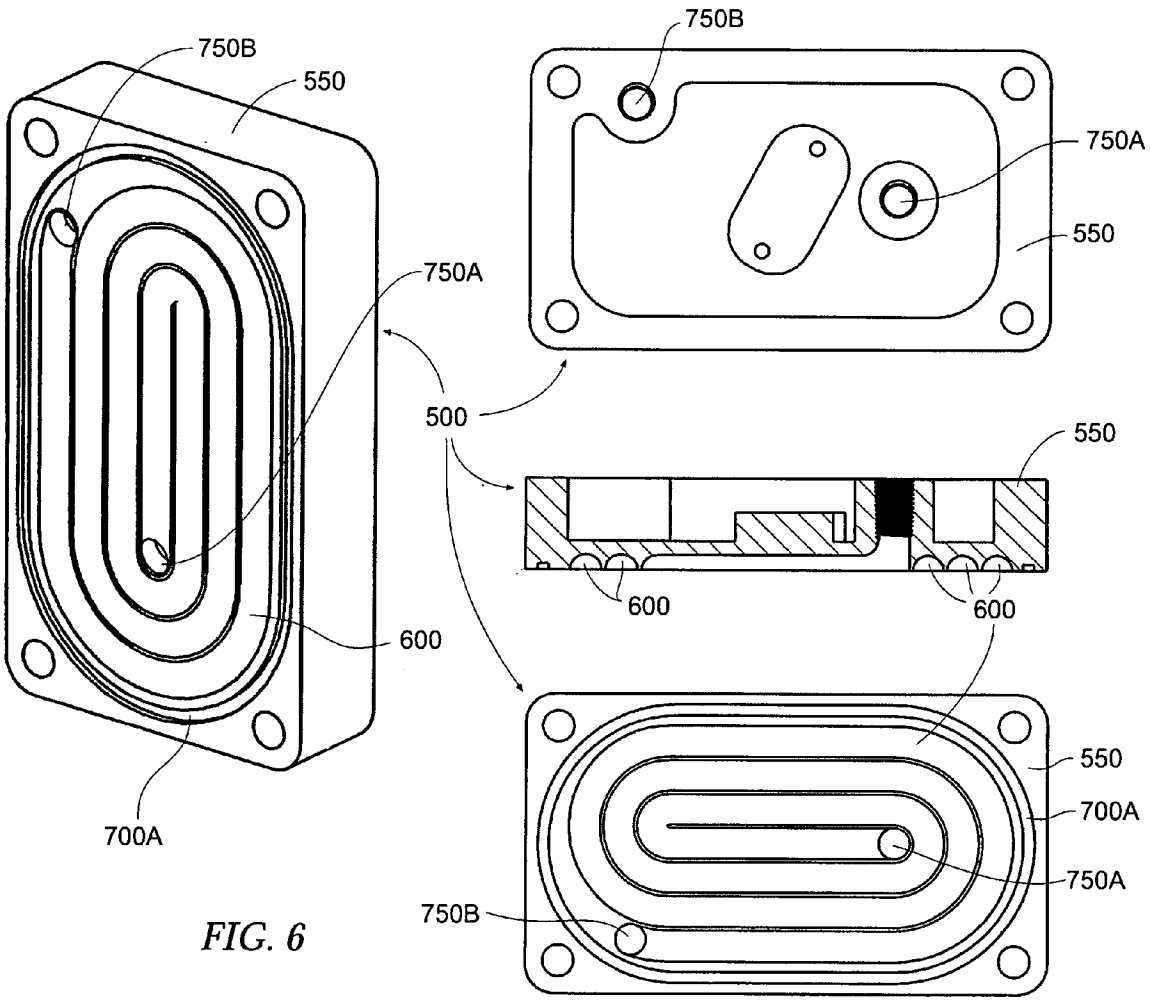

Having thus described the invention in general terms, reference will now be made to the accompanying drawings, which are not necessarily drawn to scale, and wherein:

FIG. 1 is a schematic of a prior art configuration for cooling a power module for a plasma arc power supply;

FIGS. 2, 3, and 4 are schematics of alternate configurations of a cooling arrangement for a plasma arc generation system according to embodiments of the present invention;

FIG. 5 is a schematic of a cooling device configured to engage a power module of a plasma arc power supply, as part of a cooling arrangement of a plasma arc generation system according to one embodiment of the present invention; and FIG. 6 is a schematic of various views of the cooling device shown in FIG. 5 according to one embodiment of the present invention.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 2-4 illustrate various embodiments of the cooling system 100 for cooling a power module 50 used, for example, to power a torch, generally represented by a torch head 200. One skilled in the art will appreciate, from the disclosure herein, that such a cooling system 100 may be applied to any torch implementing both a power module 50 and a fluid for cooling the torch head 200, wherein such a torch may be, for example, a water-cooled plasma arc torch. As such, the torch head 200 shown in the Figures is merely exemplary of a representative torch having a plasma arc generation system implementing various forms of a cooling system 100 according to the present invention, and is not intended to be limiting in any manner.

As shown in FIG. 2, a representative torch includes a torch head 200 having a power module 50 electrically connected thereto, wherein such an electrical connection is represented by electrical or power lines 75A, 75B. A power module 50 and the electrical connections 75A, 75B may be necessary, for example, in a plasma arc torch, wherein the power module 50 and electrical connections 75A, 75B provide power to the torch head 200 for initiating and maintaining the plasma formed by the torch for cutting operations. A plasma torch and/or a plasma arc generation system or power supply therefor may also include a cooling system 100 for circulating a cooling fluid, such as, for example, water or a glycol solution, to the torch head 200 to provide cooling therefor. The cooling system 100 may comprise, for example, a circulating heat removal device 300 disposed remotely with respect to the torch head 200 and having a pump 400 for circulating the cooling fluid, a heat exchanger device or radiator 450 for dissipating heat received by the cooling fluid, and a tank or reservoir 350 for providing a particular capacity of the cooling fluid for the cooling system 100. The radiator 450 may be configured as a fluid-fluid heat exchanger or a fluid-air heat exchanger, as appropriate for the particular torch and/or plasma arc generation system. One skilled in the art will also appreciate that the cooling system 100 may also be configured to be in fluid communication with the torch head 200, as appropriate, through, for example, suitable tubing or hoses, or cooling passages defined by any or all of the components.

As previously discussed, in prior instances of a torch implementing one or more power modules 50, the power module(s) 50 would often be provided with a module cooling device/system separate or discrete from the cooling system 100. That is, each power module 50 may have been provided with a separate air-cooled finned heat sink, or separate liquid cooling device/system using a cooling plate 10 as shown in FIG. 1, in addition to the cooling system 100 for the torch head 200. However, such separate provisions for cooling the power module(s) 50 may have tended to be inefficient, thereby reducing the power output of the power module(s) 50 and/or may have caused additional power modules 50 to be required for providing sufficient power for operating the torch. In addition, the separate provisions for cooling the power module(s) 50 may have, in some instances, resulted in a bulkier or larger torch power supply (due to the extra components), a costlier torch power supply, possibly a less reliable torch power supply, and/or a more complex torch power supply.

Accordingly, in order to address such issues, one embodiment of the present invention, as shown in FIG. 2, implements a cooling device 500 capable of being operably engaged with the power module(s) 50 of a plasma arc generation system and configured to cooperate with the circulating heat removal device 300 of the cooling system 100 used to cool the torch head 200, such that the cooling fluid circulated by the cooling system 100 is also used to cool the power module(s) 50. The cooling device 500 is configured to receive the cooling fluid in such a manner that the cooling fluid directly engages the power module 50 and receives the heat generated thereby. For example, the cooling device 500 may be configured to cooperate with a surface of the power module 50, such as the interaction surface 50A, so as to define at least one channel 600 therebetween, wherein at least a portion of the channel 600 is define by the interaction surface 50A of the power module 50. As will be discussed in connection with FIGS. 5 and 6, the channel 600 includes a fluid inlet 750A and a fluid outlet 750B for receiving and discharging, respectively, the cooling fluid. The circulation of the cooling fluid through the cooling device 500 thus removes or dissipates the heat from the power module 50 as the cooling fluid passes through the radiator 450.

In one aspect of the invention, the channel 600 defined by the cooling device 500/power module 50 is arranged as a portion of the cooling system 100 for cooling the torch head 200. More particularly, the channel 600 may be disposed in series with the torch head 200 so that a separate cooling system for the cooling device 500 is not required. As shown in FIG. 2, the channel 600 may be disposed in series with and upstream of the torch head 200 such that the cooling fluid leaving the pump 400 first circulates through the channel 600 defined by the cooling device 500/power module 50, before circulating to the torch head 200 and then back to the radiator 450 for dissipating the collected heat. Such a configuration may be advantageous in one aspect, since the power module 50 typically adds relatively less heat to the cooling fluid than the torch head 200, and thus the increase in temperature of the cooling fluid leaving the power module 50 is generally less than the temperature increase in the cooling fluid caused by the torch head 200. Accordingly, such a configuration may provide sufficient cooling of the power module 50, since the relatively cool cooling fluid first contacts the power module 50 before collecting heat from the torch head 200, but will still be capable of providing sufficient cooling for the torch head 200 due to the relatively small amount of heat collected from the power module 50.

However, alternative embodiments of the present invention are shown in FIGS. 3 and 4, with FIG. 3 illustrating an embodiment wherein the flow direction of the cooling fluid is reversed as compared to the embodiment shown in FIG. 2. That is, the cooling fluid is directed by the pump 400 to the torch head 200. From the torch head 200, the cooling fluid is then serially directed to the cooling device 500 operably engaged with the power module(s) 50, whereafter, the cooling fluid leaving the power module(s) 50 is directed to the radiator 450 for dissipating the heat collected by the cooling fluid from the torch head 200 and the power module(s) 50. The cooling fluid, thus cooled, is then returned to the reservoir 350 for recirculation by the pump 400. Such a configuration may be advantageous, for example, where the most efficient operating temperature range of the power module 50 is above the temperature at which the cooling fluid leaves the circulating heat removal device 300. Accordingly, after the cooling fluid picks up the heat from the torch head 200, the cooling fluid may be adjusted to the desired temperature, for instance, with a supplemental radiator device (not shown) fluidly disposed between the torch head 200 and the power module 50, or by adjusting the flow rate of the cooling fluid (i.e., a faster flow collects relatively less heat), before the cooling fluid is directed to the power module 50.

FIG. 4 illustrates another embodiment wherein the cooling fluid is directed in parallel to the torch head 200 and the cooling device 500 operably engaged with the power module (s) 50, as compared to the embodiments showing a serial arrangement in FIGS. 2 and 3. That is, the cooling fluid is concurrently directed by the pump 400 to the torch head 200 and to the cooling device 500 operably engaged with the power module(s) 50 (the channel 600). The portions of the cooling fluid thus leaving the torch head 200 and the power module(s) 50, respectively, are then directed back to the radiator 450 for dissipating the heat collected by the cooling fluid from the torch head 200 and the power module(s) 50. That is, the cooling fluid directed to the torch head 200 does not circulate to the cooling device 500 (and vice versa) before returning to the radiator 450. Following the radiator 450, the cooling fluid, thus cooled, is then returned to the reservoir 350 for recirculation by the pump 400. In this manner, both the power module 50 and the torch head 200 are exposed to a cooling fluid of the same temperature directed from the circulating heat removal device 300

With respect to the both of the series configurations shown in FIGS. 2 and 3, the implementation of a single circulating heat removal device 300, may also provide increased operating efficiency, may be simpler and require a fewer amount of components, and may provide a physically smaller power supply assembly. For example, the cooling fluid flow through a series circulation configuration allows only one flow switch or other sensor device (not shown) to be engaged with the flow path of the cooling fluid so as to allow a clogged or plugged coolant channel to be detected anywhere in the plasma arc generation system. That is, since only one cooling fluid flow path is provided, any blockage of that path will impeded the cooling fluid flow, and thus, only a single flow switch or other sensor device (though more than one flow switch or sensor may also be used for redundancy where necessary or desired), is required to detect such a malfunction. In response to the detection of such an event, the flow switch or sensor may be configured, for example, to shut down the plasma arc generation system so as to prevent overheating. One skilled in art will appreciate, however, that other sensor devices may be provided in the alternative or in addition to a flow switch or sensor in the cooling fluid flow path. For example, the cooling device 500 may be provided with a thermal switch (i.e., as a failsafe) in case the cooling device 500/circulating heat removal device 300 fail to maintain the power module 50 below a predetermined threshold temperature. In any instance, references to such sensors herein are for exemplary purposes only and are not intended to be limiting in any manner.

FIGS. 5 and 6 illustrate various views of a cooling device 500 according to one embodiment of the present invention, wherein the cooling device 500 is configured to operably engage a power module 50 such that the cooling fluid circulated therethrough directly contacts or engages the power module 50 and thereby reduces, minimizes, or eliminates thermal interfaces between the power module 50 and the cooling fluid, to provide increased heat removal. The direct contact between the cooling fluid and the power module 50 provides increased cooling and may, in some circumstances, allow for a decreased number of power modules 50 required for the plasma arc generation system or power supply for a torch since each power module 50 may be able to handle more power if more efficiently and/or sufficiently cooled. In one particular aspect, the power module 50 includes an interaction surface 50A, which may be any surface thereof, smooth or not, through which heat generated by sources within the power module 50 can be directed to and conducted therethrough. For example, one such interaction surface 50A of a power module 50 may be a flat surface that, in some instances, may be referred to as a base or bottom plate. One skilled in the art, however, will appreciate that the term "base or bottom plate" is for exemplary purposes only and is not intended, in any manner, to connote an orientation, disposition, or configuration of the interaction surface 50A or the power module 50, or be otherwise restrictive in this regard in any manner. That is, the interaction surface 50A could be any or all of the side surfaces, the bottom surface, and the top surface of the power module 50.

As shown in FIGS. 5 and 6, in instances where the interaction surface 50A is flat, the cooling device 500 may be configured to engage the interaction surface 50A with a sealing member 700 disposed therebetween to provide a fluid-tight seal. Such a sealing member 700 may comprise, for example, a suitable o-ring or other gasket. In some instances, the cooling device 500 may define a groove 700A for receiving at least a portion of the sealing member 700 for retaining the sealing member 700 in place as the cooling device 500 is engaged with the power module 50. One skilled in the art will appreciate, however, that the power module 50 (particularly, the interaction surface 50A) may, in some instances, define a groove (not shown) for receiving at least a portion of the sealing member 700 in the alternative to, or in addition to, the groove 700A defined by the cooling device 500. One skilled in the art will further appreciate, however, that many other sealing techniques between the power module 50 and the cooling device 500 may be employed, and that the configurations disclosed herein are for exemplary purposes only. For instance, the cooling device 500 may be secured to the power module 50 by an epoxy adhesive, or integrally formed with the power module 50.

In one embodiment, the cooling device 500 may comprise a block element 550 configured to define at least one channel 600 for directing the cooling fluid about the interaction surface 50A of the power module 50, where the block element 550 may be comprised of, for example, a metal such as aluminum. The at least one channel 600 is further configured such that, when the cooling device 500 is engaged with the power module(s), the interaction or engagement surface 50A of the respective power module 50 forms at least a portion of the at least one channel 600 such that the cooling fluid is capable of directly engaging the interaction surface 50A. One skilled in the art will appreciate, however, that the at least one channel 600 may alternatively be defined, for example, by the interaction surface 50A of the power module 50 (wherein the cooling device 500 may then comprise a flat plate), or by a combination of the cooling device 500 and the interaction surface 50A. As such, the configurations described herein are for exemplary purpose only and are not intended to be limiting in any respect. Further, as shown in FIGS. 5 and 6, the at least one channel 600 may be configured in the form of a spiral within the plane of the block element 550 and disposed radially inward of the groove 700A for receiving the o-ring 700, and extending from a fluid inlet 750A to a fluid outlet 750B for receiving and discharging, respectively, the cooling fluid. Note that, in some instances, the cooling fluid may be directed into "the fluid outlet 750B" and discharged from "the fluid inlet 750A" where necessary and/or desired.

Many modifications and other embodiments of the inventions set forth herein will come to mind to one skilled in the art to which these inventions pertain having the benefit of the teachings presented in the foregoing descriptions and the associated drawings. For example, though the embodiments of the present invention have been discussed herein in terms of a torch, particularly a plasma arc torch, one skilled in the art will appreciate that such embodiments will be similarly applicable to other devices, systems, and methods implementing a power supply or other power electronics such as, for instance, a power supply for welding equipment or power electronics associated with a drive motor. As such, the embodiments disclosed herein are provided only for exemplary purposes and are not intended to be limiting in any manner. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A plasma arc generation system, comprising:

a power module structured and arranged to be operably engaged with a plasma arc torch head portion and adapted to provide an electrical current for causing an arc at the torch head portion for generating a plasma; and a cooling device operably engaged with the power module so as to direct a fluid thereto for cooling the power module, the cooling device being configured such that the fluid directly contacts the power module to receive heat therefrom generated by the power module, wherein the cooling device is structured and arranged to be operably engaged with the torch head portion and is further configured to direct the fluid thereto for cooling the torch head portion, the cooling device also being configured such that the fluid is directed in parallel to the power module and the torch head portion.

2. A plasma arc generation system according to claim 1, wherein the fluid comprises one of a liquid and a gas.

3. A plasma arc generation system, comprising:

a power module structured and arranged to be operably engaged with a plasma arc torch head portion and adapted to provide an electrical current for causing an arc at the torch head portion for generating a plasma; and a cooling device operably engaged with the power module so as to direct a fluid thereto for cooling the power module, the cooling device being configured such that the fluid directly contacts the power module to receive heat therefrom generated by the power module, wherein the power module includes a surface and the cooling device includes a cooling plate operably engaged with the surface, the surface and the cooling plate being configured to cooperate to define at least one channel therebetween for channeling the fluid over the surface and in direct contact therewith so as to allow the fluid to receive the heat generated by the power module.

4. A plasma arc generation system according to claim 3, further comprising:

a plasma arc torch head portion adapted to receive an electrical current and configured such that the electrical current causes an arc at the torch head portion for generating a plasma, the power module being operably engaged with the torch head portion to provide the electrical current thereto.

5. A plasma arc generation system according to claim 4 wherein the cooling device is operably engaged with the torch head portion and is further configured to direct the fluid thereto for cooling the torch head portion, the cooling device also being configured such that the fluid is directed serially between the power module and the torch head portion.

6. A plasma arc generation system according to claim 5 wherein the fluid is directed serially from the power module to the torch head portion.

7. A plasma arc generation system according to claim 5 wherein the fluid is directed serially from the torch head portion to the power module.

8. A plasma arc generation system, comprising:

a plasma arc torch head portion adapted to receive an electrical current and configured such that the electrical current causes an arc at the torch head portion for generating a plasma;

a power module operably engaged with the torch head portion and adapted to provide the electrical current thereto; and a cooling device operably engaged with the power module so as to direct a fluid thereto for cooling the power module, the cooling device being configured such that the fluid directly contacts the power module to receive heat therefrom generated by the power module, wherein the cooling device is operably engaged with the torch head portion and is further configured to direct the fluid thereto for cooling the torch head portion, the cooling device also being configured such that the fluid is directed in parallel to the power module and the torch head portion.

9. A plasma arc generation system according to claim 8, wherein the fluid comprises one of a liquid and a gas.

10. A plasma arc generation system according to claim 8, wherein the power module includes a surface and the cooling device includes a cooling plate operably engaged with the surface, the surface and the cooling plate being configured to cooperate to define at least one channel therebetween for channeling the fluid over the surface and in direct contact therewith so as to allow the fluid to receive the heat generated by the power module.

11. A method of cooling a plasma arc generation system, comprising:

directing a fluid to a power module, the power module being operably engaged with a plasma arc torch head portion and adapted to provide an electrical current thereto for causing an arc at the torch head portion for generating a plasma, the power module defining an exterior surface, such that the fluid directly contacts the exterior surface of the power module to receive heat therefrom generated by the power module; and directing the fluid to the torch head portion so as to receive heat therefrom generated by the plasma, the fluid being directed one of serially between and in parallel to the power module and the torch head portion so as to provide cooling for the plasma arc generation system.

12. A method according to claim 11 wherein, when the fluid is directed serially, directing the fluid serially further comprises directing the fluid serially from the power module to the torch head portion.

13. A method according to claim 11 wherein, when the fluid is directed serially, directing the fluid serially further comprises directing the fluid serially from the torch head portion to the power module.

14. A method of cooling a plasma arc generation system, comprising:

directing a fluid to a power module, the power module being operably engaged with a plasma arc torch head portion and adapted to provide an electrical current thereto for causing an arc at the torch head portion for generating a plasma, such that the fluid directly contacts the power module to receive heat therefrom generated by the power module; and directing the fluid to the torch head portion so as to receive heat therefrom generated by the plasma, the fluid being directed one of serially between and in parallel to the power module and the torch head portion so as to provide cooling for the plasma arc generation system, wherein directing the fluid to the power module further comprises directing the fluid between a surface of the power module and a cooling plate of the cooling device operably engaged with the surface, the surface and the cooling plate being configured to cooperate to define at least one channel therebetween, so as to channel the fluid over the surface and in direct contact therewith to allow the fluid to receive the heat generated by the power module.

* * * * *